United States Patent [19]

Staudenmayer et al.

[11] Patent Number: 4,840,860

[45] Date of Patent: Jun. 20, 1989

[54] MULTIACTIVE ELECTROPHOTOGRAPHIC ELEMENT

[75] Inventors: William J. Staudenmayer, Pittsford; David S. Weiss, Rochester; Joseph A. Pavlisko, Pittsford, all of N.Y.

[73] Assignee: Eastman Kodak Company, Rochester, N.Y.

[21] Appl. No.: 168,822

[22] Filed: Mar. 16, 1988

[51] Int. Cl.[4] ..... G03G 5/05

[52] U.S. Cl. ..... 430/59; 430/96

[58] Field of Search ..... 430/59, 96

[56] References Cited

U.S. PATENT DOCUMENTS 4,330,608 5/1982 Limburg et al. ..... 430/59

FOREIGN PATENT DOCUMENTS 50-151152 12/1975 Japan ..... 430/96

62-212660 9/1987 Japan ..... 430/96

*Primary Examiner*—Paul R. Michl

*Assistant Examiner*—Jeffrey A. Lindeman

*Attorney, Agent, or Firm*—David F. Janci

[57] ABSTRACT

An improved reusable multiactive electrophotographic element has a charge-transport layer comprising a triarylamin charge-transport material in a mixture of binders comprising poly[2,2-bis(4-hydroxyphenyl)propane carbonate] and a polyester of 4,4'-(2-norbornylidene)diphenol and terephthalic and azelaic acids, with the weight ratio of the polycarbonate to the polyester being in the range of 9:1 to 3:7.

4 Claims, No Drawings

MULTIACTIVE ELECTROPHOTOGRAPHIC ELEMENT

FIELD OF THE INVENTION

This invention relates to multiactive electrophotographic elements, i.e., elements containing a charge-generation layer and a chargetransport layer. More particularly, the invention relates to such elements which are reusable and contain a triarylamine charge-transport material in the charge-transport layer.

BACKGROUND

In electrophotography an image comprising an electrostatic field pattern, usually of non-uniform strength (also referred to as an electrostatic latent image), is formed on an insulative surface of an electrophotographic element comprising at least a photoconductive layer and an electrically conductive substrate. The electrostatic latent image is usually formed by imagewise radiation-induced dissipation of the strength of portions of an electrostatic field of uniform strength previously formed on the insulative surface. Typically, the electrostatic latent image is then developed into a toner image by contacting the latent image with an electrographic developer. If desired, the latent image can be transferred to another surface before development.

In latent image formation the imagewise radiation-induced dissipation of the initially uniform electrostatic field is brought about by the creation of electron/hole pairs, which are generated by a material (often referred to as a charge-generation or photoconductive material) in the electrophotographic element in response to exposure to the imagewise actinic radiation. Depending upon the polarity of the initially uniform electrostatic field and the types of materials included in the electrophotographic element, part of the charge that has been generated, i.e., either the holes or the electrons, migrate toward the charged insulative surface of the element in the exposed areas and thereby cause the imagewise dissipation of the initial field. What remains is a non-uniform field constituting the electrostatic latent image.

Such elements contain material which facilitates the migration of generated charge toward the oppositely charged surface in imagewise exposed areas in order to cause imagewise field dissipation. Such material is often referred to as a chargetransport material.

One type of well-known charge-transport material comprises a triarylamine. The term, "triarylamine," as used herein is intnded to mean any chemical compound containing at least one nitrogen atom that is bonded by at least three single bonds directly to aromatic rings or ring systems. The aromatic rings or ring systems can be unsubstituted or can be further bonded to any number and any types of substituents. Such triarylamines are well known in the art of electrophotography to be very capable of accepting and transporting charges generated by a charge-generation material.

Among the various known types of electrophotographic elements are those generally referred to as multiactive elements (also sometimes called multilayer or multi-active-layer elements). Multiactive elements are so named, because they contain at least two active layers, at least one of which is capable of generating charge in response to exposure to actinic radiation and is referred to as a charge-generation layer (hereinafter referred to as a CGL), and at least one of which is capable of accepting and transporting charges generated by the charge-generation layer and is referred to as a charge-transport layer (hereinafter referred to as a CTL). Such elements typically comprise at least an electrically conductive layer, a CGL, and a CTL. Either the CGL or the CTL is an electrical contact with both the electrically conductive layer and the remaining CGV or CTL. Of course, the CGL comprises at least a charge-generation material (a photoconductor); the CTL comprises at least a charge-transport material; and either or both layers may additionally comprise a film-forming polymeric binder.

Among the known multiactive electrophotographic elements, are those which are particularly designed to be reusable and to be sensitive to imagewise exposing radiation falling within the visible and/or infrared regions of the electromagnetic spectrum. Reusable elements are those that can be practically utilized through a plurality (preferably a large number) of cycles of uniform charging, imagewise exposing, development and/or transfer of electrostatic latent image or toner image, and erasure of remaining charge, without unacceptable changes in their performance. Visible and/or infrared radiation-sensitive elements are those that contain a charge-generation material which generates charge in response to exposure to visible and/or infrared radiation. Many such elements are well known in the art.

For example, some reusable multiactive electrophotographic elements which are designed to be sensitive to visible radiation are described in U.S. Pat. Nos. 4,578,334 and 4,719,163, and some reusable multiactive electrophotographic elements which are designed to be sensitive to infrared radiation are described in U.S. Pat. Nos. 4,666,802 and 4,701,396.

Many known reusable multiactive elecrophotographic elements sensitive to visible or infrared radiation also employ triarylamine charge-transport materials in their CTL. In those elements the triarylamine is dispersed or dissolved in a film-forming polymeric binder that forms the CTL. Such elements are described, for example, in the four U.S. patents noted above. Those patents teach many polymers as having utility as film-forming binders are CTL's. Among the many polymers so described, are polycarbonates, such as poly[2,2-bis(4-hydroxyphenyl)-propane carbonate] (commonly referred to as bisphenol A polycarbonate), and polyesters, such as one formed from the condensation of 4,4'-(2-norbornylidene)-diphenol and terephthalic and azelaic acids. Elements containing such components fairly adequately perform their intended functions, and, in the case of the elements described in the four U.S. Patents noted above, have some very important advantages over other known elements. However, the present inventors have recognized some significant drawbacks associated with such elements.

For example, if the CTL comprises a triarylamine in a bisphenol A polycarbonate film, a significant problem may arise. The problem can occur when the CTL has been adventitiously exposed to ultraviolet radiation (i.e., radiation of a wavelength less than about 400 nanometers, which, for example, forms a significant portion of the radiation emitted by typical fluorescent room lighting). This can occur, for example, when the electrophotographic element is incorporated in a copier apparatus and is exposed to typical room illumination during maintenance or repair of the copier's internal components. The problem, which we will refer to as a UV-fogging problem, is manifested as a buildup of residual potential within the electrophotographic element over time as the element is exercised through its normal cycles of electrophotographic operation after having been adventitiously exposed to ultraviolet radiation.

For example, in normal cycles of operation such an element might be initially uniformly charged to a potential of about −500 volts, and it might be intended that the element should then discharge, in areas of maximum exposure to normal imagewise actinic visible or infrared exposing radiation, to a potential of about −100 volts, in order to form the intended latent electrostatic image. However, if the electrophotographic element has been adventitiously exposed to ultraviolet radiation, thr will be a buildup of residual potential that will not be erased by normal methods of erasing residual charge during normal electrophotographic operation. For example, after about 500 cycles of operation, the unerasable residual potential may be as much as −200 to −300 volts, and the element will no longer be capable of being discharged to the desired −100 volts. This results in false images being formed in areas of maximum imagewise exposure that should correspond to highlights, i.e., areas of no image density in the original image being copied. In effect, the element has become no longer reusable, after only 500 cycles of operation.

While the mechanism of this UV-fogging problem is not presently understood, the present inventors theorize that the problem may be caused by a chemical change in the triarylamine charge-transport material, induced by absorption of ultraviolet radiation. This is evidenced by an observed color change in the CTL after exposure to ultraviolet radiation. It would be desirable to be able to avoid or minimize this UV-fogging problem.

On the other hand, the present inventors have recognized that, if the electrophotographic element comprises a CTL, wherein the triarylamine is contained in a binder film of a polyester such as one formed from the condensation of 4,4'-(2-norbornylidene)-diphenol and terephthalic and azelaic acids, the UV-fogging problem does not arise. The present inventors theorize that this may be because the polyester absorbs more ultraviolet radiation than does a bisphenol A polycarbonate, and thus prevents some of the ultraviolet radiation from being absorbed by the triarylamine in significant enough amounts to cause the chemical change that leads to the UV-fogging problem, and/or the polyester or some complex of the polyester with the triarylamine may otherwise quench or prevent the UV-induced chemical change from occurring.

Unfortunately, such elements having such a polyester as their CTL binder exhibit another drawback recognized by the present inventors; namely, they have significantly lower sensitivity to actinic visible or infrared radiation (sometimes referred to as lower speed) than do elements that utilize bisphenol A polycarbonate as their CTL binder. For example, in some cases the exposure to actinic radiation necessary for discharging the initial uniform electrostatic field from −500 to −100 volts (sometimes referred to as the 100-volt speed), is about 55 percent more when such a polyester is the CTL binder, compared to when bisphenol A polycarbonate is the CTL binder. This is a very significant difference in terms of high speed copiers; i.e., the copier using polycarbonate as the CTL binder can make nearly 5 exposures in the same time it takes the copier with the noted particular polyester CTL binder to make 3 exposures. It would, of course, be desirable to retain this speed advantage of the polycarbonate.

It thus becomes evident that there is a need for a reusable visible and/or infrared-sensitive electrophotographic element that avoids or minimizes the UV-fogging problem of element utilizing a polycarbonate CTL binder, while at the same time avoiding or minimizing the speed loss inherent in elements utilizing polyester CTL binder. The present invention meets this need.

SUMMARY OF THE INVENTION

It has been unexpectedly found that the speed loss of polyester CTL binder can be minimized, and the UV-fogging problem of polycarbonate CTL binder can at the same time be minimized, if the CTL is formed from a mixture of a certain weight ratio of binders comprising a certain polycarbonate and a certain polyester.

Thus, the invention provides an electrophotographic element comprising: an electrically conductive support; a charge-generation layer comprising a photoconductive material sensitive to visible or infrared radiation; and a charge-transport layer containing a triarylamine charge-transport material. The element additionally contains the improvement wherein the charge-transport layer comprises a mixture of a polycarbonate comprising poly[2,2-bis(4-hydroxyphenyl)propane carbonate-]and a polyester formed from 4,4'-(2-norbornylidene)diphenol and terephthalic and azelaic acids, and the weight ratio of the polycarbonate to the polyester is in the range of 9:1 to 3:7.

Surprisingly, such an element provides the majority of the speed advantage of one with just polycarbonate binder even when polycarbonate is not the major portion of the binder mixture, and provides the majority of the UV-fogging-avoidance of one with just polyester binder even when the polyester binder is not the major portion of the binder mixture. Thus, the effect is a synergistic one, being more beneficial than the expected sum of the parts.

It should also be noted that this synergistic beneficial effect is peculiar to the particular binders defined above. Combining a bisphenol A polycarbonate with just any polyester, will not necessarily produce the beneficial effect (although the present inventors have found one other polyester that will also produce the beneficial effect in mixture with bisphenol A polycarbonate, and elements utilizing it are described in copending U.S. patent application Ser. No. 168,835, filed Mar. 16, 1988) For example, combining bisphenol A polycarbonate with a different polyester, instead, e.g., poly(ethylene-co-neopentylene terephthalate), or a polyester formed from bisphenol A and azelaic acid, or a polyester formed from ethylene glycol and 1,1,3-trimethyl−3-(4-carboxyphenyl)-5-indancarboxylic acid, in weight ratios within the range defined above, does not adequately avoid the UV-fogging problem and retain sufficient speed.

DESCRIPTION OF PREFERRED EMBODIMENTS

As previously defined, the invention pertains to any reusable multiactive electrophotographic element designed to be sensitive to visible and/or infrared radiation and containing any triarylamine charge-transport material in a polymeric CTL. Elements of that type and their preparation and use are well known in the art of electrophotography, and, therefore, a detailed redescription of such elements and their preparation and use is neither necessary, nor will it be presented herein. For detailed description of such elements and their preparation and use, see, for example, U.S. Pat. Nos. 3,041,166; 3,165,405; 3,394,001; 3,679,405; 3,725,058; 4,578,334; 4,666,802; 4,702,396; and 4,719,163, the disclosures of which are hereby incorporated herein by reference. The only difference between such well-known elements and elements of the present invention is in the present use of a particular mixture of particular binders in the CTL.

However, there are presented below a general description and some examples of some preferred embodiments of the invention.

Although the invention will achieve its purpose adequately when the weight ratio of polycarbonate:polyester is within the range of 9:1 to 3:7 as previously defined, it has been found that virtually all the UV-fogging-avoidance feature of the polyester and almost all the speed advantage of the polycarbonate are retained if the polyester forms from 20 to 40 percent by weight of the mixture of the two binders. Thus, in some preferred embodiments of the invention the weight ratio of the bisphenol A polycarbonate to the polyester of 4,4'-(2-norbornylidene)bisphenol and terephthalic and azelaic acids is within the range of 8:2 to 6:4, inclusive.

While the ratio of terephthalic acid to azelaic acid used in forming the polyester does not appear to be important in regard to the beneficial effects of the invention, in some preferred embodiments the molar ratio of terephthalic acid:azelaic acid is 40:60.

Although the invention is applicable when any triarylamine serves as a charge-transport material in the CTL, in a particularly preferred embodiment of the invention, the CTL contains the charge-transport material, 1,1-bis[4-(di-4-tolylamino)phenyl]-3-phenylpropane.

Of course, multiactive electrophotographic elements of the invention can contain any of the optional additional layers and components known to be useful in reusable multiactive electrophotographic elements in general, such as, e.g., subbing layers, overcoat layers, barrier layers, screening layers, leveling agents, surfactants, plasticizers, sensitizers, and release agents.

The following examples are presented to further illustrate some preferred electrophotographic elements of the invention and to compare heir properties and performance to those of elements outside the scope of the invention.

EXAMPLE 1

An electrophotographic element of the invention was prepared as follows.

A conductive support was utilized, comprising a 178 micrometer thickness of poly(ethylene terephthalate) film having vacuum-deposited thereon a thin conductive layer of nickel.

An adhesive layer was coated onto the nickel surface of the conductive support from a solution of 4.8 g of poly(acrylonitrile-co-vinylidene chloride) (17:83 molar ratio) in 1.2 kg of methyl ethyl ketone solvent and dried. Coverage after drying was 21.5 mg/m$^2$.

A charge-generation layer was vacuumdeposited onto the adhesive layer by sublimation of the charge-generation material, N,N'-bis(2-phenethyl)perylene-3,4:9,10-bis(dicarboximide), from a resistance-heated tantalum crucible at a temperature of about 181° C., a pressure of $1.14\times10^{-3}$ Pa, and a crucible to substrate distance of 25 cm, to achieve a coverage of 380 mg/m$^2$.

A charge-transport layer was prepared in darkness by dispersing 0.19 g of the charge-transport material, 4,4'-bis(diethylamino)tetraphenylmethane, and 30.0 g of the triarylamine charge-transport material, 1,1-bis[4-(di-4-tolyamino)phenyl]-3-phenylpropane, in 606.8 g of the solvent, dichloromethane, and then adding to the solvent: 30.24 g of poly[2,2-bis(4-hydroxyphenyl)propane carbonate] (abisphenol A polycarbonate sold under the trademark, Makrolon 5705, by Mobay Chemical Co., USA); 12.96 g of a polyester of 4,4'-(2-norbornylidene)-diphenol and terephthalic acid:azelaic acid (40:60 molar ratio) (in order to achieve a polycarbonate: polyester weight ratio of 7:3); 1.8 g of a third polymer, poly(ethylene-co-neopentylene terephthalate) (55:45 molar ratio) (to serve as an adhesion promoter); and 0.19 g of a siloxane surfactant sold under the trademark, DC 510 by Dow Corning, USA. The mixture was stirred for 24 hours to dissolve the polymers in the solvent and was then coated onto the charge-generation layer and dried to form the charge-transport layer at a dry coverage of 23.7 g/m$^2$ (a thickness of about 22 micrometers).

The resultant electrophotographic element was exposed to typical fluorescent room lighting (having typically significant amounts of ultraviolet output) for 15 minutes at an illuminance of 753 lux, to simulate adventitious exposure to ultraviolet radiation.

The electrophotographic element was then subjected to 500 cycles of operation comprising initially uniformly charging the element to −500 volts, exposing the element through the CTL to sufficient visible radiation to discharge the element to −100 volts (to simulate imaging exposure), and then exposing the element to excess visible radiation in order to erase the remaining charge. The amount of imaging exposure to visible radiation necessary to reduce the charge from −500 to −100 volts was only 3.6 ergs/cm$^2$ during the initial cycle of operation. After 500 cycles of operation, it was found that the residual potential remaining in the element after attempted erasure by excess radiation was only about −40 volts.

This illustrates that the element exhibited very high speed and very little UV-fogging.

Similar results are achieved when the molar ratio of terephthalic acid:azelaic acid from which the polyester is formed is 60:40 or 80:20.

Also, similar results are achieved when the triarylamine charge-transport material in the CTL is tri-p-tolylamine or 1,1-bis(4-di-i-tolylaminophenyl)-cyclohexane.

EXAMPLES 2–7 and Comparative Examples (Controls) A–D

Additional Examples (2–7) of electrophotographic elements within the scope of the invention and Comparative Examples (A–D) of control elements outside the scope of the invention were prepared and tested in order to further illustrate the synergistic beneficial effects of the invention.

The elements of all these examples were prepared and tested exactly as described in Example 1, except that the weight ratio of polycarbonate to polyester was different for each example (in calculating the weight ratios, the small amount of the third polymer included in the CTL as an adhesion promoter was disregarded). Results are presented in Table I.

TABLE I

| Example | Element of the invention? | CTL weight ratio of polycarbonate: polyester | residual potential[1] (volts) | necessary exposure[2] (ergs/cm$^2$) |
|---|---|---|---|---|
| A | no | 100:0 | −220 | 3.4 |
| B | no | 95:5 | −160 | 3.7 |
| 2 | yes | 90:10 | −80 | 3.8 |
| 3 | yes | 80:20 | −60 | 3.8 |
| 4 | yes | 75:25 | −55 | 3.7 |
| 1 | yes | 70:30 | −40 | 3.6 |
| 5 | yes | 60:40 | −35 | 3.6 |
| 6 | yes | 50:50 | −30 | 4.0 |
| 7 | yes | 30:70 | −32 | 3.9 |
| C | no | 10:90 | −35 | 4.3 |
| D | no | 0:100 | −20 | 5.3 |

[1]residual potential, after exposure to ultraviolet radiation and 500 cycles of operation
[2]amount of exposure to visible radiation necessary to discharge element from −500 to −100 volts during initial cycle of operation The results in Table I illustrate that, at polycarbonate:polyester ratios of 90:10 or lower, the UV-fogging problem was minimized enough, so that the element remains sufficiently reusable (residual potential remains less than −100 volts after 500 cycles) in operations involving discharging the element from −500 volts to −100 volts; i.e., the majority of the UV-fogging-avoidance property of the polyester is provided, even when the polyester comprises as little as 10 percent by weight of the mixture of binders.

The results in Table I also illustrate that at polycarbonate:polyester ratios of 30:70 or higher the speed loss was minimized enough, so that relatively low amounts of exposure are required in operations involving discharging the element from −500 volts to −100 volts; i.e., the majority of the speed advantage of the polycarbonate is retained, even when the polycarbonate comprises as litle as 30 percent by weight of the mixture of binders.

The results in Table I further illustrate that the control elements, those having polycarbonate: polyester ratios outside the range of 9:1 to 3:7, exhibited either unacceptable UV-fogging or undesirably significant speed loss.

The invention has been described in detail with particular reference to certain preferred embodiments thereof, but it should be appreciated that variations and modifications can be effected within the spirit and scope of the invention.

What is claimed is:

1. In an electrophotographic element comprising: an electrically conductive support; a charge-generation layer comprising a photoconductive material sensitive to visible or infrared radiation; and a charge-transport layer containing a triarylamine charge-transport material, the improvement wherein the charge-transport layer comprises a mixture of a polycarbonate comprising poly[2,2-bis(4-hydroxyphenyl)propane carbonate] and a polyester formed from 4,4'-(2-norbornylidene)diphenol and terephthalic and azelaic acids, and the weight ratio of the polycarbonate to the polyester is in the range of 9:1 to 3:7.

2. The electrophotographic element of claim 1, wherein the molar ratio of terephthalic acid:azelaic acid from which the polyester was formed is 40:60.

3. The electrophotographic element of claim 1, wherein the weight ratio of the polycarbonate to the polyester is in the range of 8:2 to 6:4.

4. The electrophotographic element of claim 1, wherein the triarylamine charge-transport material comprises 1,1-bis[di−4-tolylamino)phenyl]-3-phenylpropane.

* * * * *